US010688806B2

(12) United States Patent
Matsusaki

(10) Patent No.: US 10,688,806 B2
(45) Date of Patent: Jun. 23, 2020

(54) THERMAL HEAD AND THERMAL PRINTER

(71) Applicant: KYOCERA Corporation, Kyoto-shi, Kyoto (JP)

(72) Inventor: Yuuki Matsusaki, Kirishima (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 16/108,298

(22) Filed: Aug. 22, 2018

(65) Prior Publication Data

US 2019/0100027 A1 Apr. 4, 2019

(30) Foreign Application Priority Data

Sep. 29, 2017 (JP) ..... 2017-191628

(51) Int. Cl.

*B41J 2/335* (2006.01)
*B41J 2/355* (2006.01)
*B41J 2/325* (2006.01)

(52) U.S. Cl.

CPC ..... *B41J 2/3353* (2013.01); *B41J 2/325* (2013.01); *B41J 2/3351* (2013.01); *B41J 2/3354* (2013.01); *B41J 2/3355* (2013.01); *B41J 2/3357* (2013.01); *B41J 2/3359* (2013.01); *B41J 2/33515* (2013.01); *B41J 2/33525* (2013.01); *B41J 2/33535* (2013.01); *B41J 2/33545* (2013.01); *B41J 2/33595* (2013.01); *B41J 2/355* (2013.01); *B41J 2/33505* (2013.01)

(58) Field of Classification Search

CPC .... B41J 2/3353; B41J 2/33525; B41J 2/3354; B41J 2/33545; B41J 2/3357; B41J 2/3359; B41J 2/33595; B41J 2/33515; B41J 2/3351; B41J 2/355; B41J 2/33535; B41J 2/3355; B41J 2/325; B41J 2/33505

See application file for complete search history.

(56) References Cited

U.S. PATENT DOCUMENTS 5,222,291 A * 6/1993 Ota ..... B41J 2/345 29/414
8,384,749 B2 * 2/2013 Morooka ..... B41J 2/33585 347/200
2012/0154504 A1 * 6/2012 Ono ..... B41J 2/335 347/202

FOREIGN PATENT DOCUMENTS

CN 102555517 A 7/2012
JP S57-024273 A 2/1982
JP H09-234895 A 9/1997

* cited by examiner

*Primary Examiner* — Yaovi M Ameh
(74) *Attorney, Agent, or Firm* — Volpe and Koenig, P.C.

(57) ABSTRACT

A thermal head includes a substrate, a glaze layer, and a reinforced conductor layer. The glaze includes a first glaze and a second glaze. The first glaze extends in a predetermined direction on the surface of the substrate. The second glaze is spaced part from the first glaze to one side in a direction perpendicular to the predetermined direction on the surface of the substrate. The reinforced conductor layer includes a lateral side part. The lateral side part extends on the surface of the substrate from the first glaze side to the second glaze side and is partially located on the second glaze. An edge part on the first glaze side in the second glaze includes a cutout portion cut out toward the one side in the direction perpendicular to the predetermined direction. The lateral side part passes through the cutout portion.

10 Claims, 10 Drawing Sheets

THERMAL HEAD AND THERMAL PRINTER

CROSS-REFERENCE

The present application claims priority under 35 U.S.C. § 119 to Japanese Patent Application No. 2017-191628, filed on Sep. 29, 2017, entitled "THERMAL HEAD AND THERMAL PRINTER". The content of which is incorporated by reference herein in its entirety.

TECHNICAL FIELD

The present disclosure relates to a thermal head and a thermal printer.

BACKGROUND ART

Known in the art is a thermal head performing printing by applying heat to heat sensitive paper or by applying heat to an ink film (ink ribbon) for thermal transfer printing (Patent Literature 1 or 2). Such a thermal head is for example configured by stacking a substrate, glaze layer (heat storage layer), heat generating layer (resistor layer), conductive layer, and protective layer in that order. Individual electrodes and a common electrode included in the conductive layer are used to apply voltage to the heat generating layer to generate heat, whereby heat is given to the heat sensitive paper or ink film sliding over the protective layer. PTL 1 and PTL 2 disclose provision of a reinforced conductor layer superposed on the common electrode. The reinforced conductor layer for example contributes to reduction of wiring resistance.

CITATION LIST

Patent Literature

Patent Literature 1: Japanese Patent Publication No. 57-24273A

Patent Literature 2: Japanese Patent Publication No. 9-234895A

SUMMARY OF INVENTION

A thermal head according to one aspect of the present disclosure includes: a substrate; a glaze layer including a first glaze which extends in a predetermined direction on the surface of the substrate; and a second glaze which is spaced apart from the first glaze to one side in a direction perpendicular to the predetermined direction on the surface of the substrate; and a first conductive layer including a lateral side part which extends on the surface of the substrate from the first glaze side to the second glaze side and which is partially located on the second glaze. An edge part of the second glaze on the first glaze side includes a cutout portion which is cut out toward the one side in the direction perpendicular to the predetermined direction. The lateral side part passes through the cutout portion.

A thermal printer according to one aspect of the present disclosure includes the above thermal head, a conveying mechanism which conveys a recording medium onto the thermal head, and a platen roller which presses the recording medium against a top of the thermal head.

DESCRIPTION OF EMBODIMENTS

Figure 1:
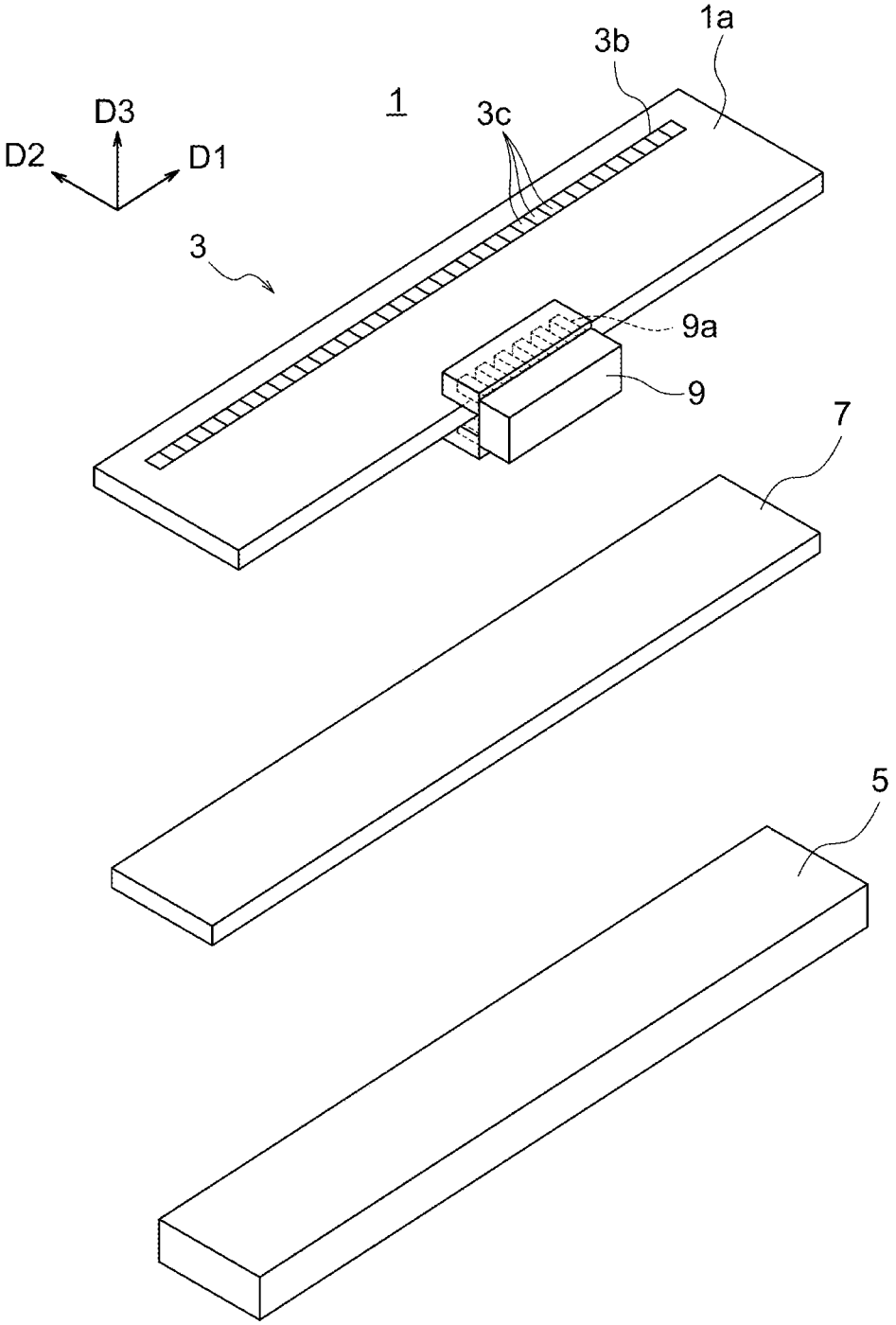
FIG. 1 A disassembled perspective view showing a schematic configuration of a thermal head according to an embodiment.

Below, a thermal head 1 according to an embodiment will be explained with reference to the drawings. Note that, in the drawings, for convenience, an orthogonal coordinate system comprised of a D1 axis, D2 axis, and D3 axis will be attached. In the thermal head 1, any direction may be defined as "above" or "below". For convenience, however, sometimes an "upper surface" and other terms will be used where the positive side of the D3 axis is the upper part.

(Overall Configuration of Thermal Head)

FIG. 1 is a disassembled perspective view showing a schematic configuration of the thermal head 1.

The thermal head 1 is configured so as to perform printing on a recording medium on the positive side of the D3 axis which is conveyed in the D2 axis direction (for example +D2 side). The recording medium is for example heat sensitive paper and is printed on by heat being given from a major surface 1*a* of the thermal head 1 facing the positive side of the D3 axis. Alternatively, for example, the recording medium is paper other than a heat sensitive paper and is printed on by heat being given from the major surface 1*a* of the thermal head 1 to an ink film superposed on the paper for thermal transfer printing. Note that, in the following description, sometimes heat sensitive paper will be used as an example of the recording medium.

The thermal head 1, for example, has a head base body 3 configuring the major surface 1*a* thereof, a heat dissipating plate 5 positioned at a back surface of the head base body 3, an adhesive member 7 interposed between the head base body 3 and the heat dissipating plate 5, and a connector 9 connected to the head base body 3.

The head base body 3 has a heating line 3*b* on the major surface 1*a* side which applies heat to the heat sensitive paper (or ink film). The heating line 3*b* is configured by a plurality of heating parts 3*c* aligned in the D1 axis direction. Note that, FIG. 1 shows boundaries of the plurality of heating parts 3*c*. However, the boundaries do not always appear in the outer appearance of the head base body 3. When the heat sensitive paper is sliding over the heating line 3*b* in the D2 axis direction (strictly speaking, a component of the D3 axis direction may be included as well), the temperatures of the plurality of heating parts 3*c* are individually controlled, whereby any two-dimensional image may be formed on the heat sensitive paper.

The head base body 3, for example, when viewed on a plane, is formed in a rectangular shape having long sides extending in the D1 axis direction and short sides extending in the D2 axis direction. The heating line 3*b*, for example, is positioned on a side closer to one side (one long side in the example shown) other than the center of the head base body 3 and extends along this one side (for example in parallel to). The side of the head base body 3 opposite to the one side along which the heating line 3*b* extends (the side of the other long side in the example shown) is used as the terminal side to which the connector 9 is connected.

The heat dissipating plate 5 forms a rectangular cuboid shape. The heat dissipating plate 5 is for example formed by copper, iron, aluminum, or another metal material and has a function of dissipating the heat which does not contribute to the printing of an image in the heat generated in the heating line 3*b* of the head base body 3. The adhesive member 7 adheres the head base body 3 and the heat dissipating plate 5.

The connector 9 electrically connects the head base body 3 and an electronic circuit outside of the thermal head 1. An electrical signal (voltage) is input from an external electronic circuit through the connector 9 to the head base body 3 to individually control the temperatures of the plurality of heating parts 3*c*. The connector 9 for example has a plurality of pins 9*a* abutting against a plurality of terminals 3*d* (see FIG. 4B) of the head base body 3. The plurality of pins 9*a* are for example sealed by resin. Note that, in place of the connector 9 having such configuration, a flexible printed circuit board (FPC) may be used as well.

(Overall Configuration of Head Base Body)

FIG. 2A to FIG. 4B are plan views for explaining the configuration of the head base body 3. FIG. 5 is a cross-sectional view taken along the V-V line in FIG. 3B. FIG. 6 is a cross-sectional view taken along the VI-VI line in FIG. 3B.

The head base body 3 is configured by various layers being stacked on the substrate 11. FIG. 2A to FIG. 4B show patterns (planar shapes) of those various layers from the bottom layer (substrate 11 side) in order. The configuration of the head base body 3 is substantially line symmetric about a center line CL parallel to the D2 axis direction. Therefore, FIG. 2A to FIG. 4B show only a half of the head base body 3.

FIG. 5 and FIG. 6 show the cross-section from the substrate 11 up to the uppermost layer of the head base body 3. However, the V-V line and VI-VI line are attached to FIG. 3B showing the planar shapes of the intermediate layers of the head base body 3 for easy understanding of relationships between the planar shapes of various types of layers of the head base body 3 and the cross-sectional shape of the head base body 3. Further, in FIG. 5 and FIG. 6, wirings on the negative side of the D2 axis (conductive layer 25) are omitted or schematically shown since illustration becomes difficult if the planar shapes thereof are correctly reflected upon these cross-sectional views.

Figure 2A:
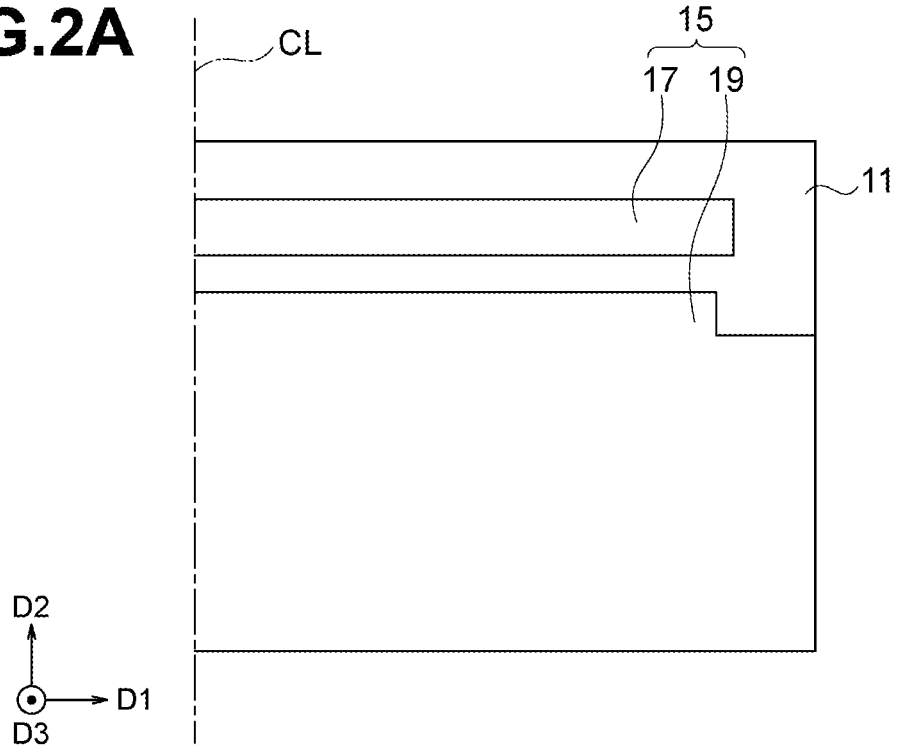
FIG. 2A is a plan view showing a glaze layer of a thermal head in FIG. 1.

As shown in FIG. 2A, FIG. 5, and FIG. 6, on the substrate 11, for example, first, provision is made of a glaze layer 15. The glaze layer 15 includes a first glaze 17 (FIG. 2A and FIG. 5) and a second glaze 19. The first glaze 17, for example, configures the internal portion side of the heating line 3*b* and contributes to heat storage and/or contributes to making of the surface of the heating line 3*b* a suitable shape. The second glaze 19, for example, is formed flatter than the surface of the substrate 11, thereby reducing possibility of disconnection and/or short-circuiting of the conductive layer 25 formed on that (FIG. 3A).

Figure 2B:
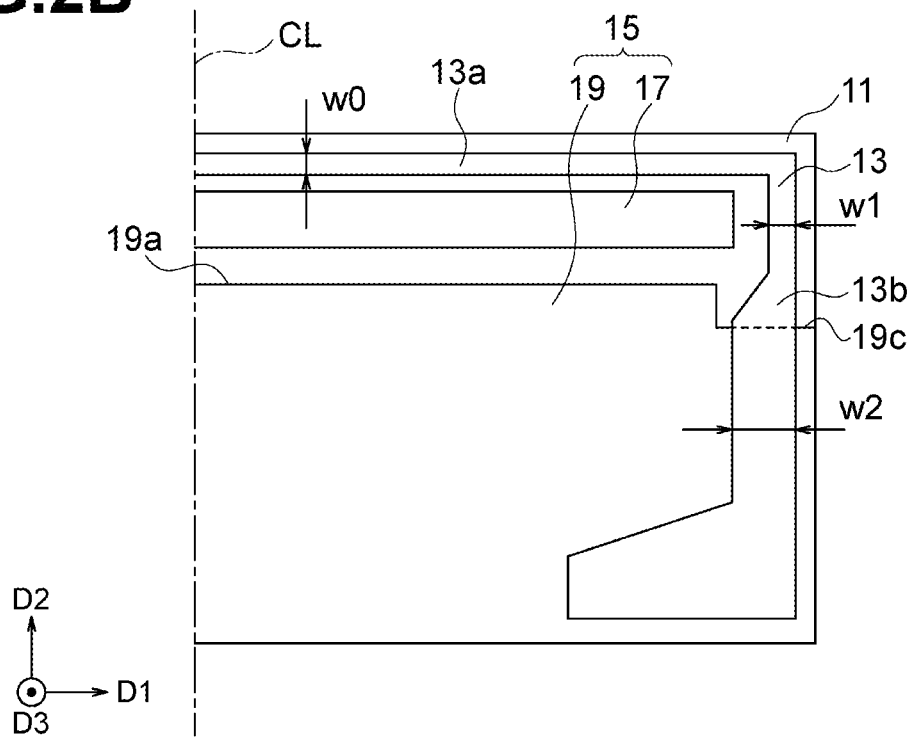
FIG. 2B is a plan view showing a reinforced conductor layer of the thermal head in FIG. 1.

Next, as shown in FIG. 2B, FIG. 5, and FIG. 6, on the substrate 11, for example, a reinforced conductor layer 13 is provided. The reinforced conductor layer 13 is for example superposed on the later explained common electrode 27, thereby performs the same action as that by making the electrode thicker, and consequently contributes to a reduction of the wiring resistance.

Next, as shown in FIG. 5 and FIG. 6, on the substrate 11, an underlying layer 21 is provided. The underlying layer 21, for example, contributes to a reduction of the possibility of etching of a layer below the underlying layer 21 and/or substrate 11 when etching a layer above the underlying layer 21 in the manufacturing process of the head base body 3. The planar shape of the underlying layer 21 is for example the same as the shape of the region where the reinforced conductor layer 13 is not arranged. Note that, due to this, the plan view of the underlying layer 21 is omitted. Further, the underlying layer 21 may be provided beneath the reinforced conductor layer 13 as well.

Figure 3A:
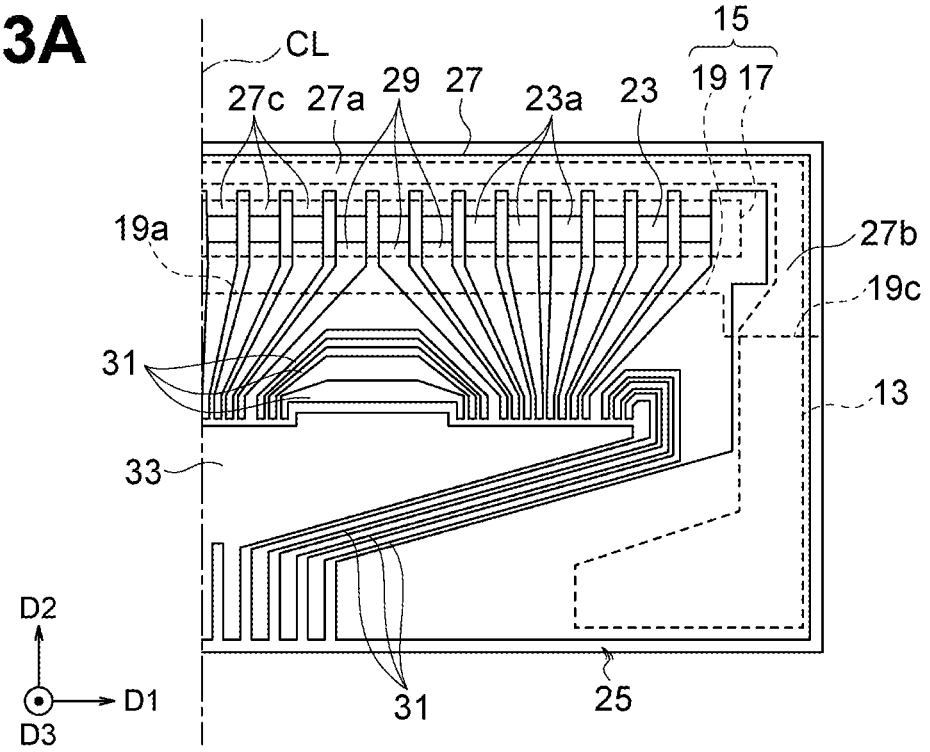
FIG. 3A is a plan view showing a heat generating layer and conductive layer of the thermal head in FIG. 1.
Figure 3B:
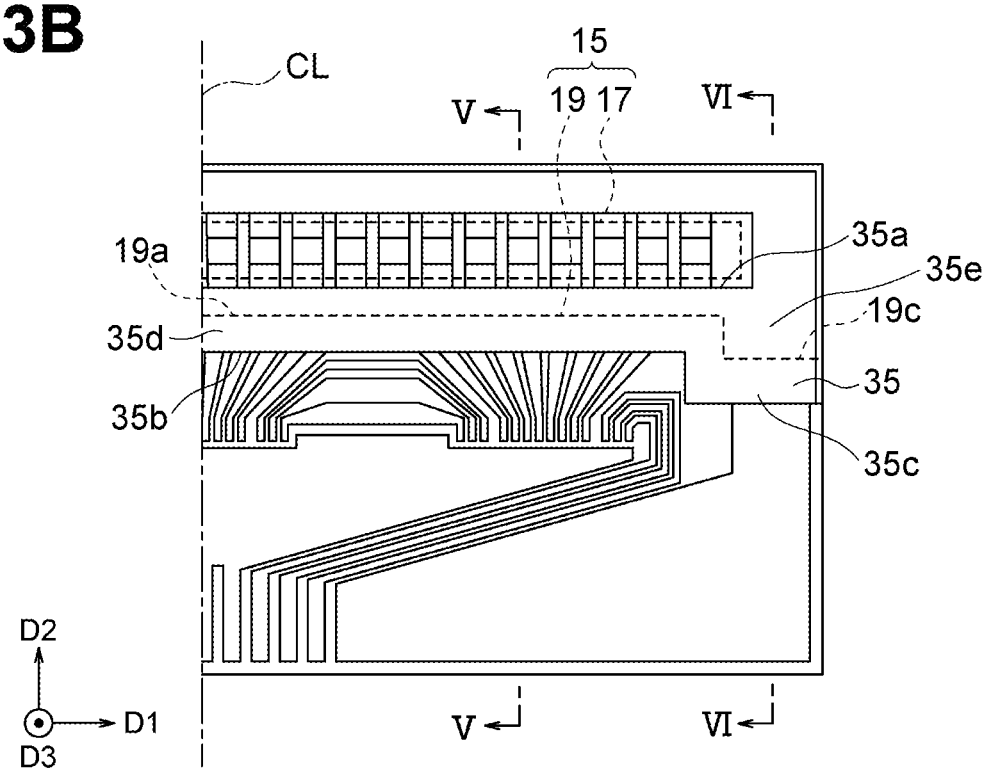
FIG. 3B is a plan view showing a reinforced insulating layer of the thermal head in FIG. 1.

Next, as shown in FIG. 3A, FIG. 5, and FIG. 6, on the substrate 11, a heat generating layer 23 is provided. In the heat generating layer 23, the portion positioned on the first glaze 17 (in the plurality of heating parts 3*c*) configures a plurality of heating element parts 23*a* generating heat by application of voltage. The planar shape of the heat generating layer 23, for example, excluding the plurality of heating element parts 23*a*, is the same as the planar shape of the conductive layer 25. Note that, due to this, a plan view of only the heat generating layer 23 (without the conductive layer 25) is omitted.

Next, as shown in FIG. 3A, FIG. 5, and FIG. 6, on the substrate 11, a conductive layer 25 is provided. The conductive layer 25, for example, includes a common electrode 27 and a plurality of individual electrodes 29 which apply voltage to the plurality of heating element parts 23*a*, a plurality of wirings 31 (FIG. 3A) performing various electrical connections, and a ground electrode 33 (FIG. 3A) to which a ground potential (reference potential) is given.

Next, as shown in FIG. 3B, FIG. 5, and FIG. 6, on the substrate 11, a reinforced insulating layer 35 is provided. The reinforced insulating layer 35, for example, contributes to the insulation between the conductive layer 25 and a protective conductor layer 41 (FIG. 4A) and/or heat insulation of the head base body 3.

Figure 4A:
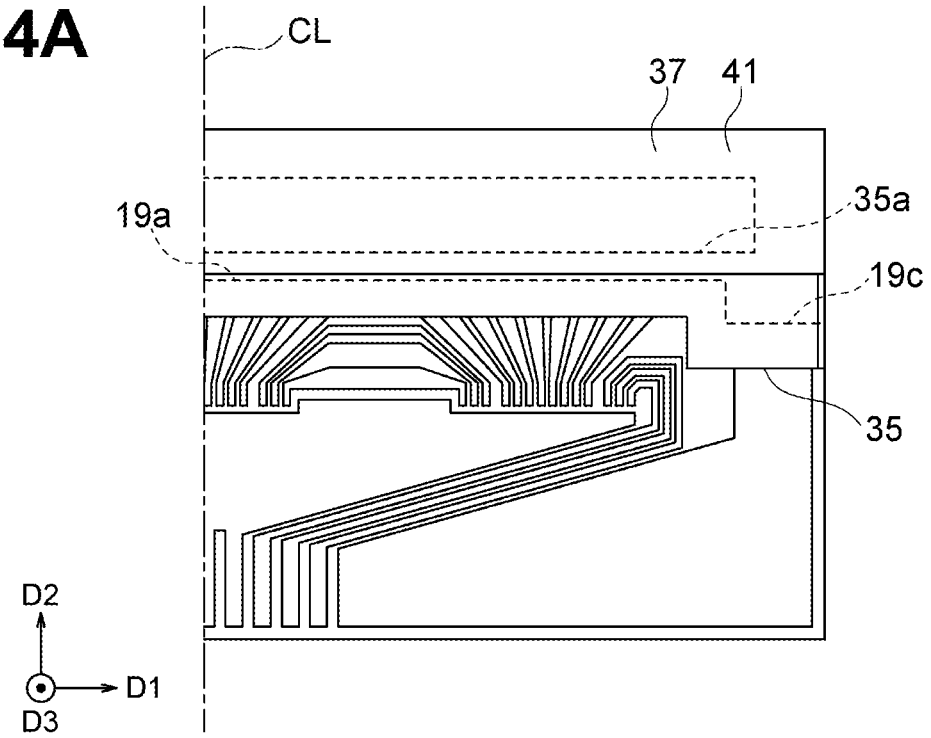
FIG. 4A is a plan view showing a protective layer of the thermal head in FIG. 1.
Figure 5:
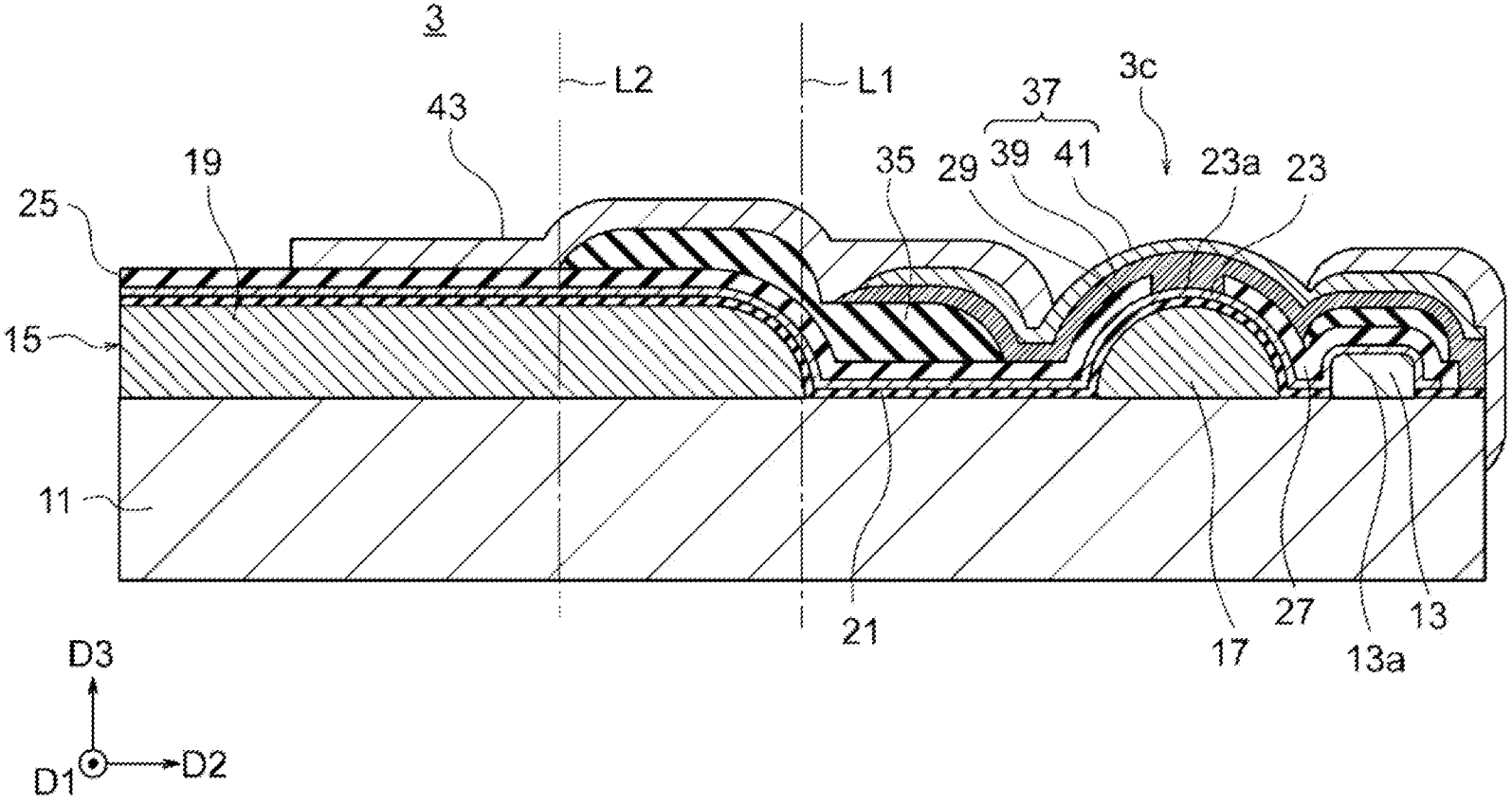
FIG. 5 A cross-sectional view taken along the V-V line in FIG. 3B.
Figure 6:
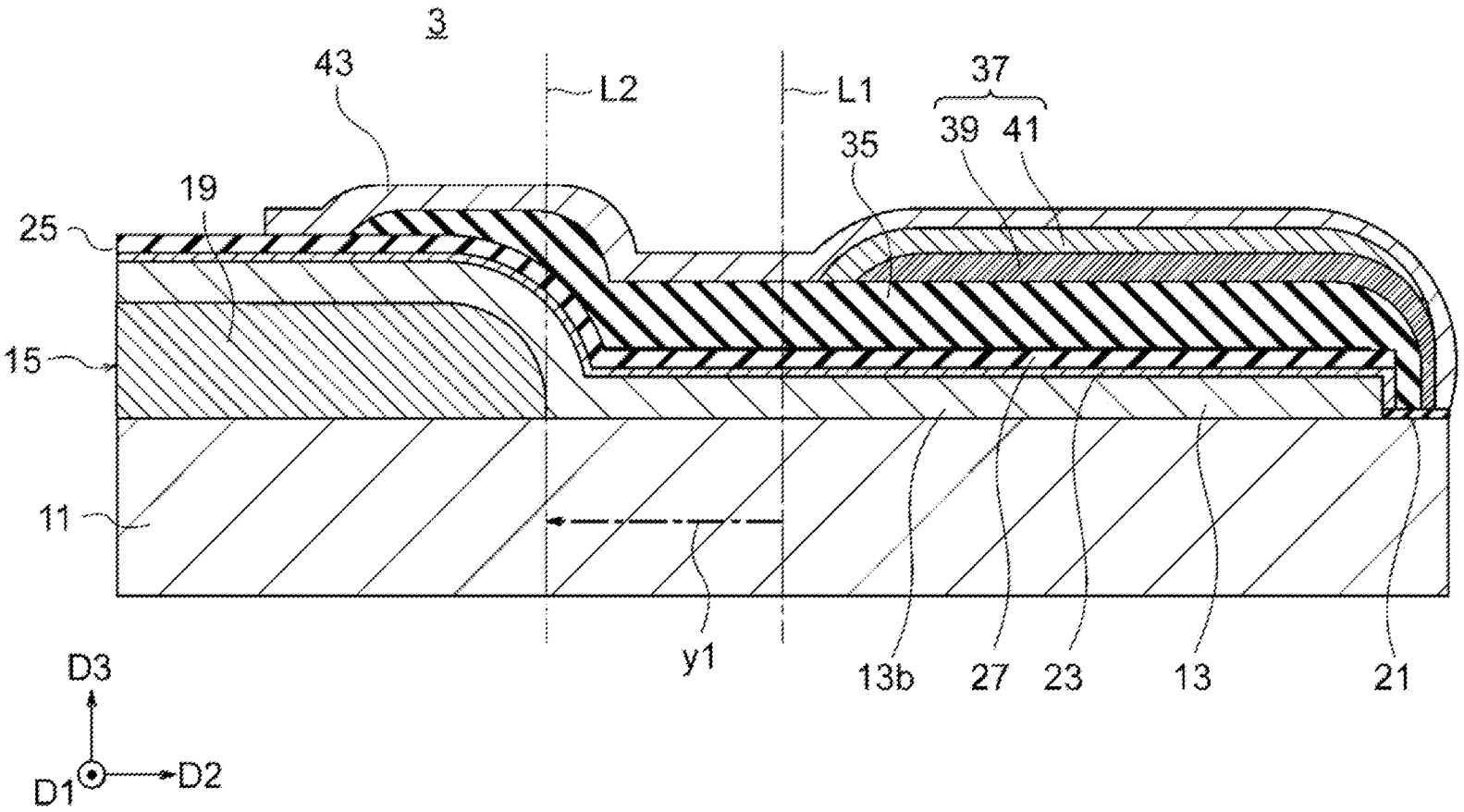
FIG. 6 A cross-sectional view taken along the VI-VI line in FIG. 3B.

Net, as shown in FIG. 4A, FIG. 5, and FIG. 6, on the substrate 11, a protective layer 37 is provided. The protective layer 37, for example, includes a protective insulating layer 39 (FIG. 5 and FIG. 6) and a protective conductor layer 41 superposed on the protective insulating layer 39. The protective layer 37, for example, contributes to the protection of the plurality of heating element parts 23*a* from the sliding movement of the heat sensitive paper (or ink film). The planar shape of the protective insulating layer 39 and the planar shape of the protective conductor layer 41 are for example substantially the same. Note that, due to this, a plan view showing only the protective insulating layer 39 (without the protective conductor layer 41) is omitted.

Figure 4B:
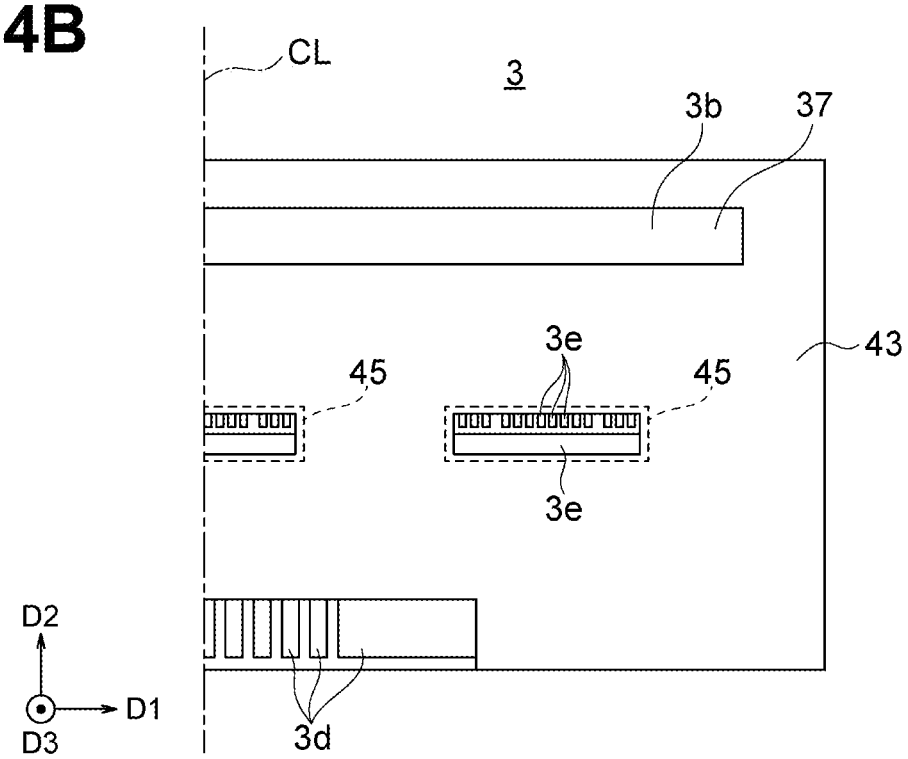
FIG. 4B is a plan view showing a coating layer of the thermal head in FIG. 1.

Next, as shown in FIG. 4B, FIG. 5, and FIG. 6, on the substrate 11, a coating layer 43 is provided. The coating layer 43 for example contributes to insulation between the conductive layer 25 and the external portion of the head base body 3 and to suppression of oxidation and/or corrosion of the conductive layer 25.

As indicated by the broken lines in FIG. 4B, in the head base body 3, drive ICs (integrated circuits) 45 applying voltage to the plurality of heating element parts 23*a* are mounted.

Below, details of the layers will be explained.

(Substrate)

The substrate 11 is for example a flat plate shape with a constant thickness. The planar shape of the substrate 11 is equal to the planar shape of the head base body 3. That is, in the present embodiment, it is a rectangle having a pair of long sides parallel to the D1 axis and a pair of short sides parallel to the D2 axis. The substrate 11 is for example formed by an alumina ceramic or another electrically insulating material or a semiconductor material such as single crystal silicon or the like.

(Glaze Layer)

The first glaze 17 particularly shown in FIG. 2A, for example, when viewed on a plane, linearly extends with a constant width in the D1 axis direction. Further, the cross-section perpendicular to the D1 axis in the first glaze 17 is for example a dome shape. The height, width, and curvature thereof may be suitably set.

Note that, the cross-sectional shape of the first glaze 17 may be, other than a dome shape, for example a shape having a flat upper surface (for example a rectangular or trapezoidal shape) or may be a shape projecting out more than the shape conceived of as a "dome shape" (for example a frustum state having a flat or curved upper side) or may be such shape of a dome shape from an upper surface of which a projection portion projects (two-step shape).

The second glaze 19 is formed in a "solid state". That is, the second glaze 19 expands in all directions (D1 axis direction and D2 axis direction) with a relatively broad area. For example, the spans of the second glaze 19 in all directions passing through the center of gravity of the figure are larger than the width of the first glaze 17. Further, for example, the planar shape of the second glaze 19 is a shape substantially made (for example, when the area is increased or reduced within a range of 20% or 10%) a polygon (for example rectangle), circle, ellipse, and/or shape forming a "convex region" as referred to in mathematics (convex set). In the example shown, the planar shape of the second glaze 19 is substantially a rectangle having four sides parallel to the four sides of the substrate 11.

The second glaze 19 is provided so that it is spaced apart from the first glaze 17 to the terminal side of the head base body 3 (−D2 side). When viewed on a plane, the edge part 19*a* of the second glaze 19 on the first glaze 17 side for example extends along (for example in parallel to) the first glaze 17. The distance between the first glaze 17 and the edge part 19*a* may be suitably set.

In the edge part 19*a* of the second glaze 19, cutout portions 19*c* are formed in the end parts of the D1 axis direction (the positions where later explained lateral side parts 13*b* in the reinforced conductor layer 13 pass). In the cutout portions 19*c*, the edge parts 19*a* extending along the first glaze 17 are cut out to the −D2 direction. The shapes of the cutout portions 19*c* are for example rectangular. The dimensions thereof may be suitably set in accordance with the shapes and dimensions of the lateral side parts 13*b*. This will be referred also in the explanation of the lateral side parts 13*b* given later.

The thickness of the first glaze 17 (the height from the substrate 11 up to the apex (top face) and the thickness of the second glaze 19 are for example substantially equal to each other. The specific values of the glaze layer 15 may be suitably set. For example, the thickness of the glaze layer 15 is 15 μm to 90 μm.

The glaze layer 15 is for example formed by glass having a low thermal conductivity. The glaze layer 15 is for example formed by mixing a suitable organic solvent with glass powder to obtain a predetermined glass paste, coating it on the upper surface of the substrate 11 by screen printing or the like, and firing this.

(Reinforced Conductor Layer)

The reinforced conductor layer 13 particularly shown in FIG. 2B is for example provided in a region which is superposed over the common electrode 27 in the conductive layer 25. Note that, the reinforced conductor layer 13 may be provided in a region which is superposed on another portion (for example ground electrode 33) in the conductive layer 25 as well.

The reinforced conductor layer 13 for example has a major part 13*a* which is positioned on the opposite side (+D2 side) from the terminal side of the head base body 13 relative to the heating line 3*b* (first glaze 17) and a pair of lateral side parts 13*b* extending from the major part 13*a* to the terminal side of the head base body 3 (−D2 side).

The major part 13*a* for example linearly extends along (for example in parallel to) the heating line 3*b* (first glaze 17) with a constant width. The specific value of the width w0 of the major part 13*a* may be suitably set.

Each lateral side part 13*b* for example extends out of the end part of the major part 13*a*, passes through the outside of the end part (outside of the D1 axis direction) of the first glaze 17, and extends up to a position adjacent to the edge part on the −D2 side of the substrate 11. The position adjacent to the edge part on the −D2 side is for example a position within a range of arrangement of the terminals 3*d* of the head base body 3 in the D2 axis direction.

The width of each lateral side part 13*b* for example becomes broader toward the −D2 side. Specifically, for example, the width w2 on the second glaze 19 becomes broader compared with the width w1 of the portion positioned outside of the end part of the first glaze 17. The further closer to the −D2 side than the portion having the width w2, the further broader the width (D1 axis direction) of the lateral side part 13*b*. However, this portion may be grasped as bending relative to the portion of the width w2 as well. The width w1 is for example 1 time to 1.5 times the width w0 of the major part 13*a*. The width w2 is for example 1.5 times to 3 times the width w1. The specific values of the widths w1 and w2 may be suitably set.

Each lateral side part 13*b* is put in a cutout portion 19*c* in the D1 axis direction (width direction of the lateral side part 13*b*). In the present embodiment, the width of the lateral side part 13*b*, in the cutout portion 19*c*, expands up to the width w2 on the second glaze 19 explained above, while the length of the cutout portion 19*c* in the D1 axis direction is made the width w2 or more. Note that, the cutout portion 19*c*, in its depth direction (D2 axis direction) as a whole, need not have a shape and size in which the width of the lateral side part 13*b* may be put. It may have a shape and size in which the width of the lateral side part 13*b* is put only in the part on the first glaze 17 side as well.

The thickness of the reinforced conductor layer 13 may be thinner than or equal to or thicker than the thickness of the conductive layer 25. For example, it may be thicker. The specific value of thickness of the reinforced conductor layer 13 may be suitably set. For example, the thickness of the reinforced conductor layer 13 is 15 μm to 35 μm or 20 μm to 30 μm. Further, for example, the thickness of the reinforced conductor layer 13 is 7 times to 70 times or 10 times to 60 times the thickness of the conductive layer 25. Further, for example, the thickness of the reinforced conductor layer 13 is for example ⅙ to 1 time or ⅓ time to 1 time the thickness of the glaze layer 15.

The material of the reinforced conductor layer 13 may be the same as or different from the material for the conductive layer 25. For example, it is different. Further, the material of the reinforced conductor layer 13 may be a suitable metal, for example, silver (Ag) or copper (Cu) or an alloy of the same. The reinforced conductor layer 13 is for example formed by adding and mixing an organic solvent with an Ag or Cu or other metal powder to obtain a predetermined conductive paste, coating it on the upper surface of the substrate 11 by screen printing or the like, and firing it.

(Underlying Layer)

The underlying layer 21 (FIG. 5 and FIG. 6) is for example formed by silicon carbide (SiC) or silicon nitride (SiN). The thickness may be suitably set. For example, it is 0.01 μm to 1 μm. The underlying layer 21 is for example formed by sputtering or another thin film forming technique. Note that, the underlying layer 21 need not be provided.

(Heat Generating Layer)

The planar shape of the heat generating layer 23 is the same as the planar shape of the conductive layer 25 except for the plurality of heating element parts 23*a* as already explained. However, the heat generating layer 23 may be configured by only a plurality of heating element parts 23*a* or by only a plurality of heating element parts 23*a* and a portion on the periphery of the same. The thickness of the heat generating layer 23 may be suitably set. For example, it is 0.01 μm to 0.5 μm.

The plurality of heating element parts 23*a* are for example linearly arranged on a line in the D1 axis direction. The pitch of the plurality of heating element parts 23*a* (pitch of the plurality of heating portions 3*c*) is for example constant. The number and density of the plurality of heating element parts 23*a* may be suitably set. For example, the density is 100 dpi (dot per inch) to 2400 dpi.

The heat generating layer 23 is for example formed by a TaN-based, TaSiO-based, TaSiNO-based, TiSiO-based, TiSiCO-based, NbSiO-based, or other material having a relatively high electrical resistance. For this reason, when voltage is applied to the heating element parts 23*a*, the heating element parts 23*a* generate heat by Joule heat generation.

The heat generating layer 23 is for example formed by forming a thin film by sputtering or another thin film forming technique, then forming the thin film into a predetermined pattern by photo-etching or the like. Note that, the etching of the heat generating layer 23 may be carried out together with the etching of the conductive layer 25 (excluding etching of tops of the heating element parts 23*a*) as well.

(Configuration of Conductive Layer Overall)

In the conductive layer 25 particularly shown in FIG. 3A, the common electrode 27 is commonly connected to the plurality of heating element parts 23*a* and gives the same potentials to the plurality of heating element parts 23*a*. The plurality of individual electrodes 29 are separately (for example one by one) connected to the plurality of heating element parts 23*a* and give potentials to the plurality of heating element parts 23*a* independently from each other. Due to this, voltages are applied independently from each other to the plurality of heating element parts 23*a* which are sandwiched between the common electrode 27 and the plurality of individual electrodes 29 when viewed on a plane, therefore printing of any image becomes possible.

The common electrode 27 is for example given a predetermined potential from the connector 9. The plurality of individual electrodes 29 are given driving signals (potentials) from the drive ICs 45. More specifically, for example, the plurality of individual electrodes 29 (plurality of heating element parts 23*a*) are classified into a plurality of groups. To the individual electrodes 29 in each group are input driving signals from the drive IC 45 provided corresponding to each group.

The plurality of wirings 31 handle connection between the drive ICs 45 and the connector 9 and connection of the plurality of drive ICs 45 to each other and contribute to input of signals in accordance with the contents of the image to the drive ICs 45. The ground electrode 33 for example connects the drive ICs 45 and the connector 9 and contributes to giving the reference potential to the drive ICs 45.

The conductive layer 25 is for example configured by aluminum (Al) or an aluminum alloy or another suitable metal. The thickness may be suitably set. It is for example 0.5 μm to 2.0 μm. The conductive layer 25 is for example formed by forming a thin film by sputtering or another thin film forming technique, then forming the thin film into a predetermined pattern by photo-etching or the like. Note that, the etching may be carried out over two processes of a process of etching the heat generating layer 23 and the conductive layer 25 together and a process of then etching the conductive layer 25 just above the heating element parts 23*a*.

(Common Electrode)

The common electrode 27, as indicated by the notations in FIG. 3A, has a major wiring part 27*a* which is positioned on the opposite side (+D2) from the terminal side of the head base body 3 relative to the plurality of heating element parts 23*a* (first glaze 17), a sub-wiring part 27*b* extending from the major wiring part 27*a* to the terminal side of the head base body 3, and a plurality of lead portions 27*c* which extend from the major wiring part 27*a* and are individually connected to the plurality of heating element parts 23*a*.

The major wiring part 27*a*, for example, linearly extends along the first glaze 17 (for example in parallel) with a constant width at the position where it is not superposed on the first glaze 17. Further, the major wiring part 27*a*, for example, covers at least a portion (entirety in the example shown) of the major part 13*a* of the reinforced conductor layer 13. The width of the major wiring part 27*a* is for example made broader than the width of the major part 13*a*.

The sub-wiring part 27*b*, for example, extends out of the end part of the major wiring part 27*a*, passes outside of the end part (outside of the D1 axis direction) of the first glaze 17, reaches the second glaze 19, and further extends up to the position adjacent to the edge part on the −D2 side of the substrate 11. A portion of the sub-wiring part 27*b* at the end part on the −D2 side, as understood from FIG. 4B, configures the terminals 3*d* to which the pins 9*a* of the connector 9 are connected. Note that, the common electrode 27 may be configured so that it is given the potential from the drive ICs 45 in place of the connector 9 as well.

The sub-wiring part 27*b*, for example, covers at least a portion (entirety in the example shown) of each lateral side part 13*b* of the reinforced conductor layer 13. The width of the sub-wiring part 27*b* is for example made broader than the width of the lateral side part 13*b*. The sub-wiring part 27*b*, for example, in the same way as the lateral side part 13*b*, passes through the cutout portion 19*c* of the second glaze 19 and the width thereof (D1 axis direction) is within the cutout portion 19*c*. However, the sub-wiring part 27*b* does not always have to be put in the cutout portion 19*c*. For example, a portion on the −D1 side may protrude to the outside of the cutout portion 19*c* as well. Note that, in the same way as the lateral side part 13*b*, in the case where the entire width of the sub-wiring part 27*b* is within the cutout portion 19*c*, the entire width of the sub-wiring part 27*b* may be within only a portion of the cutout portion 19*c* on the +D2 side.

The width of the sub-wiring part 27*b* for example becomes broader toward the −D2 side. Specifically, for example, compared with the width of its portion positioned outside of the end part of the first glaze 17, the width of its portion passing through the cutout portion 19*c* and the width of its portion covering the second glaze 19 become broader. Note that, the portion of the sub-wiring part 27*b* in the vicinity of the end part of the −D2 side may be grasped to have a width widened or may be grasped to bend so as to be along the long side on the −D2 side of the substrate 11.

The plurality of lead portions 27*c* are for example provided in one-to-one correspondence with respect to the plurality of heating element parts 23*a*, extend along (for example in parallel to) the D2 axis direction from the major wiring part 27*a*, and are connected to the +D2 side of the heating element parts 23*a*. Note that, the entirety of the lead portions 27*c* may be positioned on the first glaze 17 or portions of the lead portions 27*c* on the tip end sides may be positioned on the first glaze 17.

(Individual Electrodes)

The plurality of individual electrodes 29 are for example provided in one-to-one correspondence with respect to the plurality of heating element parts 23*a*. Further, the plurality of individual electrodes 29 for example extend from the positions where they are superposed on the second glaze 19 to the first glaze 17 side while gradually expanding it width and pitch. After that, they extend in parallel to the D2 axis direction and are connected to the −D2 side of the plurality of heating element parts 23*a*. The portions parallel to the D2 axis may be positioned on the first glaze 17 as a whole, or portions on the tip end sides may be positioned on the first glaze 17. Note that, unlike the example shown, two or more heating element parts 23*a* which are adjacent to each other may be connected with respect to one individual electrode 29 as well.

As will be understood from FIG. 4B, the end parts of the plurality of individual electrodes 29 which are on opposite side to the plurality of heating element parts 23*a* configure pads 3*e* for surface mounting of the drive ICs 45.

(Wirings and Ground Electrode)

The plurality of wirings 31 connecting the drive ICs 45 and the connector 9, as will be understood from FIG. 4B, configure at one ends the pads 3*e* on which the drive ICs 45 are surface-mounted and configure at the other ends the terminals 3*d* with which the connector 9 is connected. Each of the plurality of wirings 31 for connecting the drive ICs 45 to each other, as will be understood from FIG. 4B, configures at one end the pad 3*e* on which the drive IC 45 is surface-mounted and configures at the other end the pad 3*e* on which the other drive IC 45 is surface-mounted. Note that, the head base body 3 may be given a circuit configuration not provided with the wirings 31 for connecting the drive ICs 45 to each other as well.

The ground electrode 33 is for example formed in a solid state in the region sandwiched between the individual electrodes 29 and the common electrode 27 and plurality of wirings 31. As will be understood from FIG. 4B, a portion of the ground electrode 33 configures the pads 3*e* on which the drive ICs 45 are surface-mounted, while another portion configures the terminals 3*d* with which the connector 9 is connected.

(Reinforced Insulating Layer)

The reinforced insulating layer 35 particularly shown in FIG. 3B, for example, when viewed on a plane, is provided centered about a region free of the glaze layer 15. For example, the reinforced insulating layer 35 is provided closer to the first glaze 17 side than the region of arrangement of the drive ICs 45. The planar shape thereof is a frame shape having an opening 35*a* formed in the region of arrangement of the first glaze 17. From another viewpoint, the reinforced insulating layer 35 covers a portion of the conductive layer 25 (for example a portion of the common electrode 27 and portions of the plurality of individual electrodes 29) outside of the first glaze 17 (heating line 3*b*).

The outer edge of the reinforced insulating layer 35 (frame shape) is for example substantially rectangular having four sides parallel to the four sides of the substrate 11. The edge part 35*b* of the reinforced insulating layer 35 on the second glaze 19 side (−D2 side) is for example positioned closer to the −D2 side than the edge part 19*a* of the second glaze 19 on the first glaze 17 side (+D2 side). That is, in the reinforced insulating layer 35, a portion is superposed on the second glaze 19. However, the reinforced insulating layer 35 may be provided so as not to be superposed on the second glaze 19 as well.

The shape of the opening 35*a* is for example a shape slightly larger than the planar shape of the first glaze 17 (rectangular in the example shown). The inner edge thereof is adjacent to the outer edge of the first glaze 17. The term "adjacent" referred to here means, for example, when viewed on a plane (more specifically, for example, when viewing the bottom surface of each layer), a state where the distance of the two is not more than half of the width (D2 axis direction) of the first glaze 17.

In the edge part 35*b* on the second glaze 19 side (−D2 side) of the reinforced insulating layer 35, projection portions 35*c* projecting to the −D2 side are formed at the positions of the cutout portions 19*c* in the second glaze 19. Accordingly, in the reinforced insulating layer 35, the width (D2 axis direction) of the strip shaped portion 35*d* which is positioned on the second glaze 19 side relative to the first glaze 17 becomes broader at the positions of the cutout portions 19*c*.

The shape and dimensions of each projection portion 35*c* may be suitably set. In the example shown, the width of superposition of the second glaze 19 and the reinforced insulating layer 35 is kept substantially constant over the entire D1 axis direction, thereby each projection portion 35*c* becomes a rectangle larger than the rectangular cutout portion 19*c* by the width of superposition.

The reinforced insulating layer 35 (strip shaped portion 35*d*) includes cutout corresponding parts 35*e* which are superposed on the cutout portions 19*c*. The cutout corresponding parts 35*e* are substantially positioned in the portions having the constant width in the reinforced insulating layer 35 (portions excluding the projection portions 35*c*) by for example the edge part 35*b* of the reinforced insulating layer 35 being positioned closer to the −D2 side than the edge part 19*a* (excluding the cutout portions 19*c*) of the second glaze 19. Naturally parts or all of the cutout corresponding parts 35*e* may be configured by parts or all of the projection portions 35*c* as well.

The thickness of the reinforced insulating layer 35 is for example thinner than the thickness of the glaze layer 15. Further, the thickness of the reinforced insulating layer 35 may be for example thicker than, equal to, or thinner than the protective insulating layer 39. For example, it is thicker. The specific value of the thickness of the reinforced insulating layer 35 may be suitably set. For example, the thickness of the reinforced insulating layer 35 is 10 μm to 80 μm (however, it is thinner than the glaze layer 15). Further, for example, the thickness of the reinforced insulating layer 35 is 1 time to 40 times the thickness of the protective insulating layer 39.

The material of the reinforced insulating layer 35 may be an organic material (resin) or inorganic material. Further, the material of the reinforced insulating layer 35 may be a material having a lower thermal conductivity than the material of the glaze layer 15. As a concrete material of the reinforced insulating layer 35, for example, there can be mentioned a polyimide-based resin. A polyimide-based resin, in comparison with other resins, has higher insulation property, higher heat resistance, and higher strength and has a lower linear expansion coefficient. The reinforced insulating layer 35 is for example formed by coating a solution of polyamic acid by screen printing or another thick film forming technique, then, according to need, performing drying treatment and heat treatment.

(Protective Layer)

The protective layer 37 particularly shown in FIG. 4A is formed so as to cover at least the plurality of heating element parts 23*a*. Specifically, for example, the protective layer 37 has a broadness large enough to cover the entire first glaze 17.

Further, for example, the protective layer 37 expands to the further outer side of the first glaze 17. Specifically, for example, the protective layer 37 expands up to the edge part on the +D2 side of the substrate 11. Further, for example, the edge part on the −D2 side of the protective layer 37 is adjacent to the edge part 19*a* (excluding the cutout portion 19*c*) of the second glaze 19 on the first glaze 17 side. The term. "adjacent" referred to here means for example the state where the distance between the two is not more than half of the width (D2 axis direction) of the first glaze 17. Further, the protective layer 37, in the D1 axis direction, expands up to the edge parts of the substrate 11.

From another viewpoint, the planar shape of the protective layer 37 is for example a rectangle having four sides parallel to the four sides of the substrate 11. The long side on the +D2 side and the pair of short sides of the protective layer 37 for example substantially coincide with or are adjacent to the long side on the +D2 side and the pair of short sides of the substrate 11. The long side on the −D2 side of the protective layer 37 is parallel to the edge part 19*a* on the first glaze 17 side.

As will be understood from a comparison of FIG. 3B and FIG. 4A, in the present embodiment, a portion of the protective layer 37 outside of the first glaze 17 is substantially (for example 80% or more or 90% or more of the area of the portion of the protective layer 37 outside of the first glaze 17) superposed on the reinforced insulating layer 35. From another viewpoint, the protective layer 37 is superposed through the reinforced insulating layer 35 on the conductive layer 25 (for example a portion of the common electrode 27 and a portion of each of the plurality of individual electrodes 29). Further, the protective layer 37 is not superposed on the second glaze 19. However, the protective layer 37 may be superposed on the second glaze 19 as well.

The material of the protective insulating layer 39 in the protective layer 37 is for example silicon nitride (SiN), silicon oxide ($SiO_2$), silicon oxynitride (SiON), or silicon carbide (SiC). The thickness of the protective insulating layer 39 may be suitably set and is for example 3 μm to 15 μm.

The material of the protective conductor layer 41 in the protective layer 37 is for example titanium nitride (TiN) or diamond-like carbon. The thickness of the protective conductor layer 41 may be suitably set. For example, it is 2 μm to 10 μm. Note that, one of the protective insulating layer 39 and the protective conductor layer 41 may be thicker than the other.

The protective insulating layer 39 and the protective conductor layer 41 are for example formed by using CVD (chemical vapor deposition), sputtering, ion plating, or another thin film forming technique or screen printing or another thick film forming technique. Both of the protective insulating layer 39 and the protective conductor layer 41 may be patterned together as well. For example, both may be etched together or may be formed on the same resist mask and be patterned together by removal of the resist mask.

(Coating Layer)

The coating layer 43 particularly shown in FIG. 4B is for example provided over substantially the entire surface of the substrate 11 while exposing the heating line 3*b*, plurality of pads 3*e*, and plurality of terminals 3*d*. Note that, the opening (notation is omitted) for exposing the heating line 3*b* (the protective layer 37), for example, in the same way as the opening 35*a* of the reinforced insulating layer 35, is a shape slightly larger than the planar shape of the first glaze 17 (rectangle in the example shown). The inner edge thereof is adjacent to the outer edge of the first glaze 17.

The thickness of the coating layer 43 may be suitably set. For example, it is thinner than the thickness of the glaze layer 15. Further, for example, the thickness of the coating layer 43 may be thinner than, equal to, or thicker than the thickness of the reinforced insulating layer 35, protective insulating layer 39, or protective layer 37. For example, the thickness of the coating layer is 5 μm to 30 μm.

The material of the coating layer 43 is an epoxy resin, polyimide resin, silicone-based resin, or another resin material. The coating layer 43 is for example formed by screen printing or photolithography.

(Drive ICs)

Each drive IC 45 has a function of controlling an electric conduction state of a heating element part 23*a*. As a drive IC 45, for example, use may be made of a switching member having a plurality of switching elements inside it. The drive ICs 45 are surface-mounted on the plurality of pads 3*e* through not shown bumps and are sealed by a hard coat 47 (see FIG. 7). The hard coat 47 is for example made of an epoxy resin or silicone resin or another resin.

(Thermal Printer)

Figure 7:
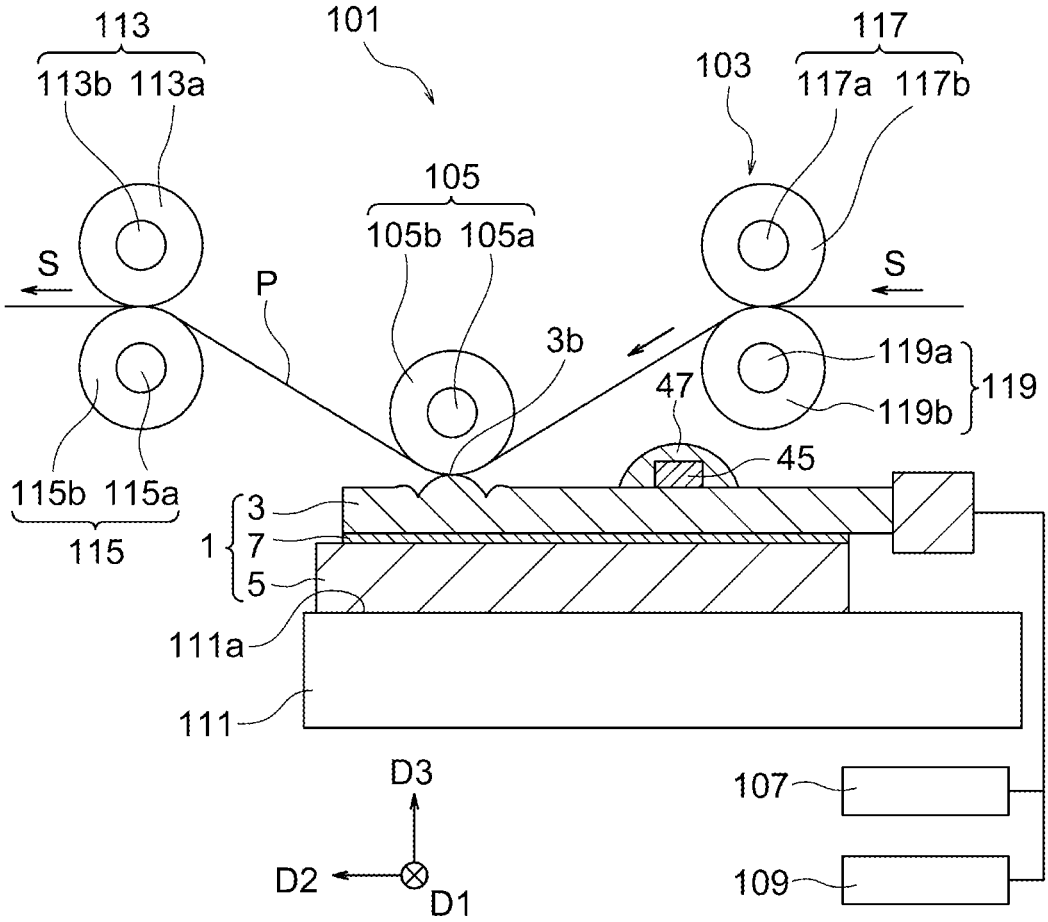
FIG. 7 A schematic diagram showing the configuration of a thermal printer having the thermal head in FIG. 1.

FIG. 7 is a schematic view showing the configuration of a thermal printer 101 having the thermal head 1.

The thermal printer 101 is provided with the thermal head 1, a conveying mechanism 103 for conveying a recording medium P (taking as an example heat sensitive paper), a platen roller 105 pushing the recording medium P against the heating line 3*b*, a power supply device 107 for supplying electrical power to them, and a control device 109 controlling their operations.

The thermal head 1 is attached to an attachment surface 111*a* of an attachment member 111 provided in a housing (not shown) of the thermal printer 101. The thermal head 1 is attached to the attachment member 111 so as to run along the direction perpendicular to the conveying direction S of the recording medium P, that is, the main scanning direction (D1 axis direction).

The conveying mechanism 103 has a drive part (not shown) and conveying rollers 113, 115, 117, and 119. The conveying mechanism 103 conveys the recording medium P in a direction indicated by an arrow S to convey the same to the top of the protective layer 37 positioned on the plurality of heating element parts 23*a* in the thermal head 1. The drive part has a function of driving the conveying rollers 113, 115, 117, and 119. For example, use can be made of a motor. The conveying rollers 113, 115, 117, and 119 can for example be configured by columnar shaft bodies 113*a*, 115*a*, 117*a*, and 119*a* made of stainless steel or another metal covered by elastic members 113*b*, 115*b*, 117*b*, and 119*b* made of butadiene rubber or the like.

Note that, although not shown, in a case where the recording medium P is a plain paper to which ink is transferred, the ink film is conveyed together with the recording medium P to a space between the recording medium P and the heating element parts 23*a* of the thermal head 1.

The platen roller 105 is arranged so as to extend along a direction perpendicular to the conveying direction S of the recording medium P. Its two end parts are supported and fixed so that it becomes able to rotate in a state where the recording medium P is pressed against the tops of the heating element parts 23*a*. The platen roller 105 can be configured by for example a columnar shaft body 105*a* made of stainless steel or another metal covered by an elastic member 105*b* made of butadiene rubber or the like.

The power supply device 107 has a function of supplying current for making the heating element parts 23*a* in the thermal head 1 generate heat as described above and current for operating the drive ICs 45. The control device 109 supplies a control signal for controlling the operations of the drive ICs 45 to the drive ICs 45 in order to selectively make the heating element parts 23*a* in the thermal head 1 generate heat.

The thermal printer 101 performs predetermined printing of an image on the recording medium P by selectively making the heating element parts 23*a* generate heat by the power supply device 107 and control device 109 while pressing the recording medium P against the tops of the heating element parts 23*a* of the thermal head 1 by the platen roller 105 and conveying the recording medium P onto the heating element parts 23*a* by the conveying mechanism 103. Note that, when the recording medium P is plain paper, the thermal printer 101 prints the image onto the recording medium P by thermal transfer of the ink of the ink film (not shown) conveyed together with the recording medium P to the recording medium P.

As described above, in the present embodiment, the thermal head 1 has the substrate 11, glaze layer 15, and reinforced conductor layer 13. The glaze layer 15 has the first glaze 17 and second glaze 19. The first glaze 17 extends in a predetermined direction (main scanning direction, D1 axis direction) on the surface of the substrate 11. The second glaze 19 is spaced to one side of the first glaze 17 in the direction (D2 axis direction) perpendicular to the D1 axis direction on the surface of the substrate 11. The reinforced conductor layer 13 includes the lateral side parts 13*b*. The lateral side parts 13*b* extend on the surface of the substrate 11 from the first glaze 17 side to the second glaze 19 side with part being positioned on the second glaze 19. In the edge part 19*a* of the second glaze 19 on the first glaze 17 side, when viewed on a plane, the cutout portions 19*c* in which the lateral side parts 13*b* is put in the D1 axis direction are formed.

Accordingly, for example, the possibility of occurrence of unwanted contact between the recording medium P and the thermal head 1 is reduced. Specifically, this is as follows.

Figure 8:
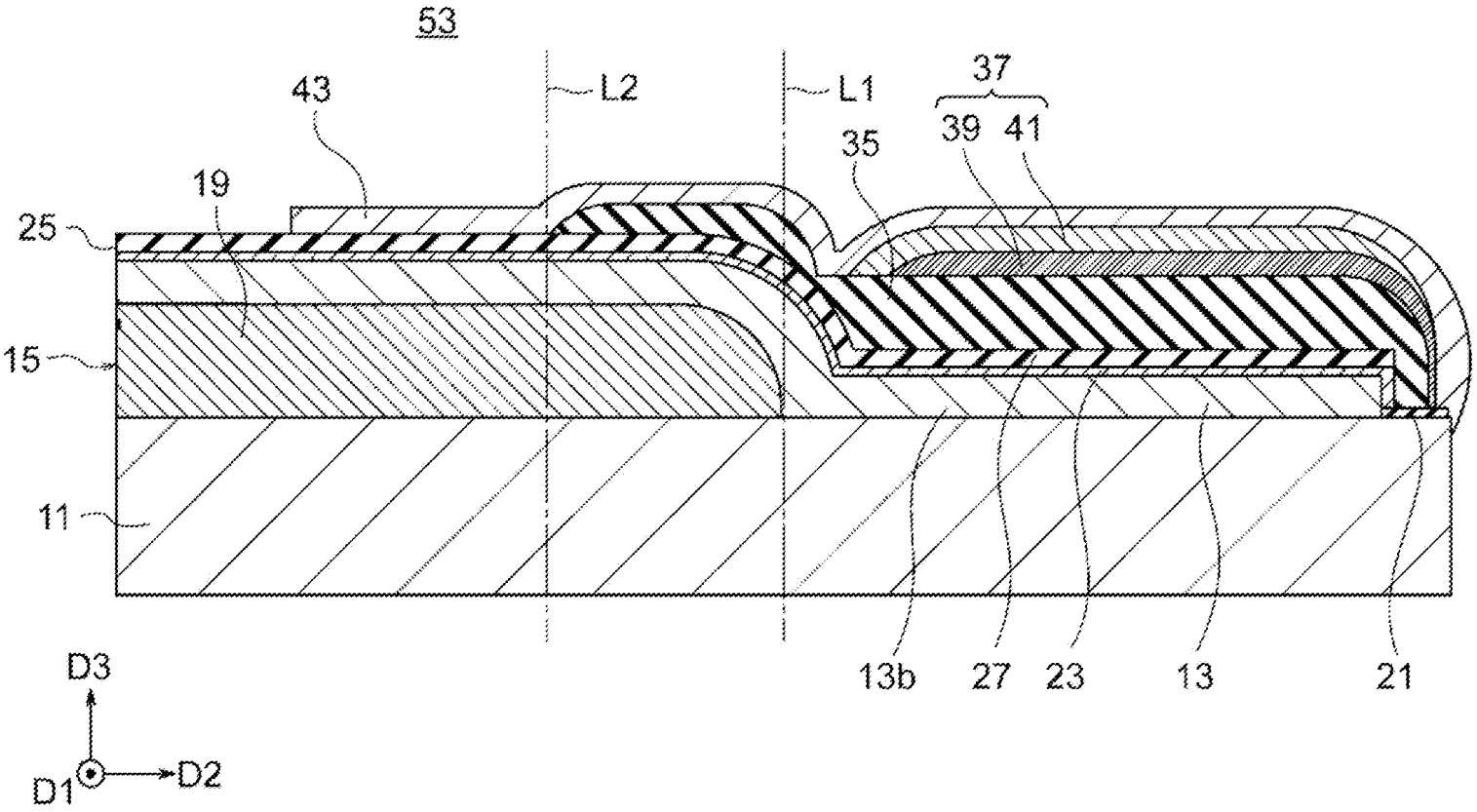
FIG. 8 A cross-sectional view corresponding to FIG. 6 and showing the configuration of a thermal head according to a comparative example.

FIG. 8 is a cross-sectional view corresponding to FIG. 6 and shows the configuration of a head base body 53 according to a comparative example. Note that, the cross-sectional view taken along the V-V line of the head base body 53 is the same as FIG. 5.

The head base body 53 differs from the head base body 3 in the embodiment in the point that no cutout portions 19*c* are provided. Here, the lines L1 in FIG. 5, FIG. 6, and FIG. 8 all indicate the position of the edge part 19*a* of the second glaze 19 on the +D2 side and show the same positions in these diagrams. Further, the lines L2 in these diagrams all indicate the position on the deep side of the cutout portion 19*c* and show the same positions in these diagrams.

As will be understood from a comparison between FIG. 5 and FIG. 8, in the region of arrangement of the second glaze 19, the thickness of the head base body 53 on the end part side of the D1 axis direction (FIG. 8) becomes thicker by the thicknesses of the lateral side parts 13*b* in the reinforced conductor layer 13 in comparison with the thickness of the head base body 53 at the center side of the D1 axis direction (FIG. 5). Further, the second glaze 19 and the reinforced conductor layer 13 are layers which being formed relatively thick. Therefore, in the region in which the second glaze 19 and the reinforced conductor layer 13 are superposed on each other, the position of the upper surface of the head base body 53 is apt to become higher. Accordingly, in the region in which the second glaze 19 and the reinforced conductor layer 13 are superposed on each other, there is a possibility that the upper surface of the head base body 53 will end up contacting the recording medium P.

However, as indicated by an arrow y1 in FIG. 6, by providing the cutout portions 19*c*, the position at which the second glaze 19 is superposed on the reinforced conductor layer 13 and where the upper surface of the head base body 3 is built up can be offset from the position indicated by the line L1 to the position of line L2. In other words, the position of buildup described above can be separated from the first glaze 17 (heating line 3*b*).

On the other hand, as shown in FIG. 7, the recording medium P is for example conveyed while being bent in a V-shape having the position of the first glaze 17 (heating line 3*b*) as the lowermost point. That is, the recording medium P is apt to contact the upper surface of the head base body 3 or 53 more the closer the position to the first glaze 17 while becomes harder to contact as the further it is separated from the first glaze 17.

Accordingly, by the provision of the cutout portions 19*c* at the positions of the lateral side parts 13*b* in the reinforced conductor layer 13 and offset of the position of buildup by the second glaze 19 to the −D2 side, the possibility of occurrence of unwanted contact between the recording medium P and the thermal head 1 is reduced. As a result, for example, occurrence of clogging of the recording medium P and/or generation of wrinkles in the recording medium P and other possibilities are reduced. From another viewpoint, in comparison with the case where no cutout portions 19*c* are provided, the edge part 19*a* (excluding the cutout portions 19*c*) of the second glaze 19 is moved closer to the first glaze 17 side, therefore a broader area can be secured for the second glaze 19. As a result, for example, the effects exerted by the second glaze 19 (for example the effect of suppression of disconnection and/or short-circuiting of the conductive layer 25) are improved.

Further, in the present embodiment, the thermal head 1 has the conductive layer 25, protective insulating layer 39, protective conductor layer 41, and reinforced insulating layer 35. The conductive layer 25 (at least a portion) is positioned on the glaze layer 15. The protective insulating layer 39 (at least a portion) is positioned on the conductive layer 25 at the position of the first glaze 17 and its periphery. The protective conductor layer 41 (at least a portion) is positioned on the protective insulating layer 39. The reinforced insulating layer 35 includes a portion which is positioned on the conductive layer 25 and under the protective conductor layer 41 (and under the protective insulating layer 39) on the outside of the first glaze 17. The reinforced insulating layer 35 includes the cutout corresponding parts 35*e*. The cutout corresponding parts 35*e* are positioned above the lateral side parts 13*b* of the reinforced conductor layer 13 at the cutout portions 19*c* and are thinner than the second glaze 19.

Accordingly, for example, a drop in the heat storage property of the second glaze 19 due to the provision of the cutout portions 19*c* can be compensated for by the reinforced insulating layer 35. By compensation of the heat storage effect in the end parts of the D1 axis direction of the head base body 3 in which the temperature distribution is apt to become abnormal, the precision of printing can be improved. The reinforced insulating layer 35 is used also for the purpose of improving the insulation property between the conductive layer 25 and the protective conductor layer 41, therefore the layers do not simply increase. For example, this is advantageous for reduction of size and reduction of cost. Further, the reinforced insulating layer 35 is thinner than the second glaze 19. Therefore, in comparison with the case where no cutout portions 19*c* are provided, unwanted contact between the recording medium P and the head base body 3 is suppressed.

Note that, the material of the reinforced insulating layer 35 may be made a material having a lower heat conductivity than the material of the second glaze 19. In this case, for example, the heat storage effect described above is improved. Further, for example, the reinforced insulating layer 35 may be formed thicker than the protective insulating layer 39. In this case, for example, the above heat storage effect and insulation effect are improved.

Further, in the present embodiment, the reinforced insulating layer 35 includes the strip shaped portion 35*d* extending along the first glaze 17 on the second glaze 19 side of the first glaze 17. The strip shaped portion 35*d* includes the cutout corresponding parts 35*e* and becomes broader by projection of the edge part on the second glaze 19 side to the second glaze 19 side at the positions of the cutout portions 19*c* (by the provision of the projection parts 35*c*).

That is, the reinforced insulating layer 35 increases in adhesion area with respect to the upper and lower layers on the end part side. On the other hand, in a case where thermal stress is generated due to the difference in thermal expansion between the layers in the head base body 3, peeling is apt to occur from the end part side. Accordingly, for example, peeling of the reinforced insulating layer 35 can be effectively suppressed.

Further, in the present embodiment, in the lateral side parts 13*b* of the reinforced conductor layer 13, the widths w2 of the portions positioned in the cutout portions 19*c* are broader than the widths w1 of the portions positioned outside of the end part of the first glaze 17.

The possibility of occurrence of unwanted contact between the head base body 3 and the recording medium P in the region in which the lateral side parts 13*b* and the second glaze 19 are superposed on each other is reduced by the cutout portions 19*c*, therefore the width of the reinforced conductor layer 13 can be made larger in this way. Further, by making the width of the reinforced conductor layer 13 larger, for example, the effect of reduction of the wiring resistance is improved.

(Modification)

Figure 9:
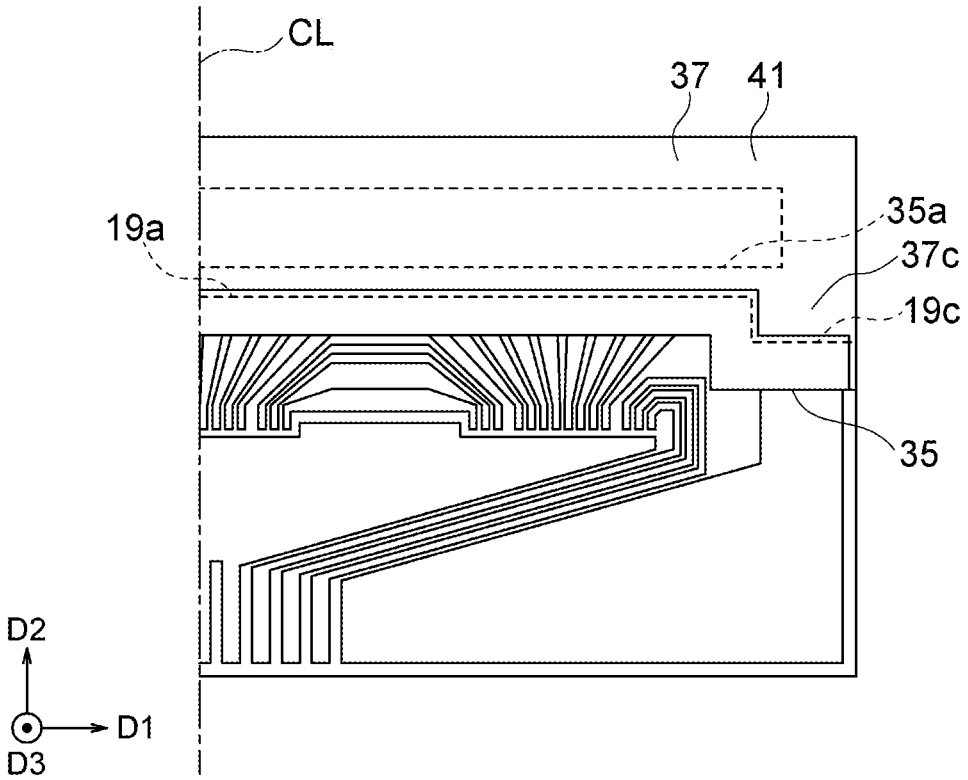
FIG. 9 A plan view showing a protective layer according to a modification.

FIG. 9 is a plan view corresponding to FIG. 4A and shows a planar shape of the protective layer 37 according to a modification. In this modification, the protective layer 37 (at least one of the protective insulating layer 39 and the protective conductor layer 41) becomes broader by the projection of the edge part on the second glaze 19 side (−D2 side) to the −D2 side at the positions of the cutout portions 19*c* (projection parts 37*c* are provided).

In the explanation of the above embodiment, the effect of suppression of peeling due to the formation of the projection parts 35*c* in the reinforced insulating layer 35 was explained. The same effect is exerted in the protective layer 37 in this modification.

The protective layer 37 in the embodiment or modification is for example formed by formation of a thin film or thick film through a mask. The mask is for example made of a resist and is patterned by photolithography. Further, the protective layer 37 in the modification may be formed by the method according to the following modification.

Figure 10A:
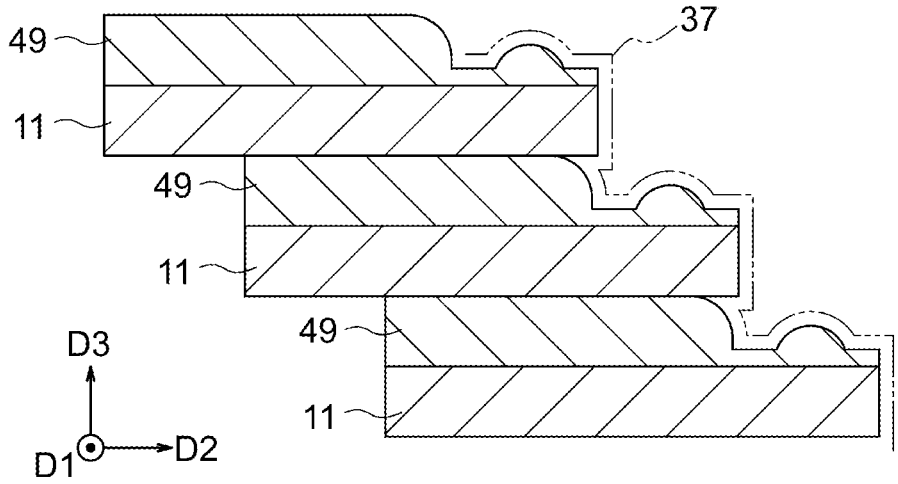
FIG. 10A and FIG. 10B are cross-sectional views for explaining a method of forming the protective layer in FIG. 9 according to the modification.
Figure 10B:
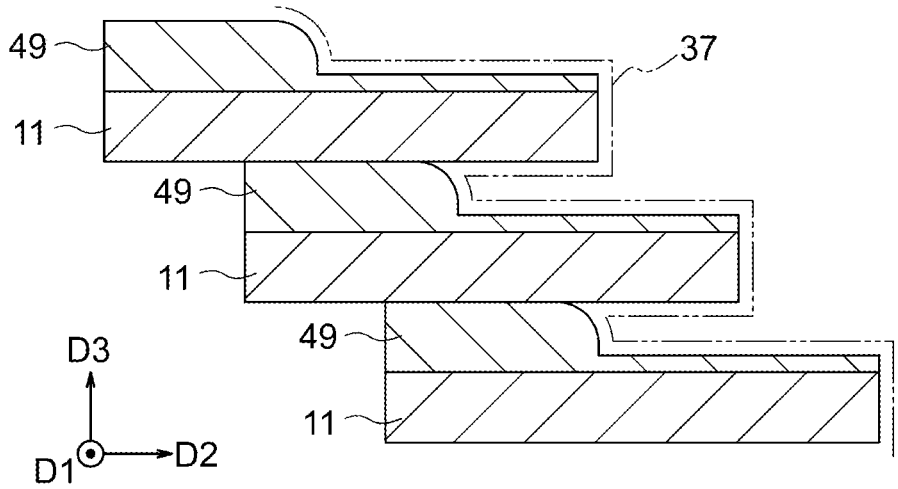

FIG. 10A and FIG. 10B are schematic cross-sectional views showing a modification of the method of formation of the protective layer 37 according to the modification. FIG. 10A corresponds to the cross-section in FIG. 5. FIG. 10B corresponds to the cross-section in FIG. 6. In these diagrams, all of the layers on the substrate 11 and under the protective layer 37 (including the glaze layer 15 and reinforced conductor layer 13) are schematically shown as the first layers 49

In this modification, first, the plurality of head base bodies 3 formed up to the first layer 49 are superposed on each other. At this time, an upper head base body 3 exposes a region in a lower head base body 3 which is equal to the region in which the protective layer 37 is formed in the embodiment. That is, the edge parts on the +D2 side of two head base bodies 3 which are superposed on each other are offset parallel to each other when viewed on a plane.

In this state, a thin film for forming the protective layer 37 is formed by CVD or the like. The thin film, as indicated by a two-dot chain line, is formed in the region in each head base body 3 which is exposed from the other head base body 3 above that. That is, for each head base body 3, the other head base body 3 which is superposed on it functions as a mask.

At this time, the thin film is formed while also entering into gaps between the head base bodies 3 due to unevenness formed by the first layers 49 on the substrates 11. On the other hand, the apex portions shown in FIG. 10B of the first layers 49 shift to the −D2 side from the apex portions shown in FIG. 10A of the first layers 49 due to the formation of the cutout portions 19*c* in the second glazes 19. Accordingly, the protective layers 37 will be formed while entering up to the positions of the cutout portions 19*c* between the head base bodies 3. As a result, the protective layers 37 according to the modification shown in FIG. 9 are formed.

Note that, in the above embodiment and modification, the reinforced conductor layer 13 is one example of the first conductor layer. The conductor layer 25 is one example of the second conductor layer.

The art according to the present disclosure is not limited to the above embodiment and modification and may be executed in various ways.

For example, in the present embodiment, an aspect in which the heating line 3*b* was provided on the major surface of the substrate 11 was exemplified. However, the heating line may be formed on the side surface (end face) of the substrate 11 or the heating line may be formed on a chamfered surface formed by chamfering an edge portion formed by the major surface and a side surface as well. Note that, as will be understood from this, the surface of the substrate on which layers such as the reinforced conductor layer and glaze layer are provided is not limited to the major surface.

Further, the reinforced conductor layer need not be provided either. That is, the first conductor layer is not limited to the reinforced conductor layer. For example, in place of provision of the reinforced conductor layer, sometimes the conductive layer configuring the common electrode etc. is formed relatively thick. This conductive layer may be the first conductor layer as well. Note that, the thickness of the first conductor layer is for example thicker than the heat generating layer and is ⅙ or more or ⅓ or more of the thickness of the glaze layer.

The thermal head need not have a reinforced insulating layer either. Further, the protective layer is not limited to one configured by two layers of the protective insulating layer and protective conductor layer. For example, it may be configured by only the protective insulating layer. The protective insulating layer may be configured by stacking materials which are different from each other as well. The reinforced insulating layer and/or protective layer need not have portions which are positioned in the cutout portions of the second glaze either.

Note that, in the present disclosure, when "located on the surface of the substrate" etc. is referred to, it does not always mean located directly on the surface of the substrate and may mean located through another layer as well. The same is true also for the case where "located on a predetermined layer" or the like.

REFERENCE SIGNS LIST

1 . . . thermal head, 3 . . . head base body, 11 . . . substrate, 13 . . . reinforced conductor layer (first conductor layer), 13*b* . . . lateral side part, 15 . . . glaze layer, 17 . . . first glaze, 19 . . . second glaze, and 19*c* . . . cutout portion.

The invention claimed is:

1. A thermal head comprising:
a substrate comprising a surface;
a glaze layer on the surface, comprising
a first glaze elongated in a first direction, and
a second glaze separated from the first glaze in a second direction perpendicular to the first direction; and
a first conductive layer on the surface, comprising a lateral side part which extends from the first glaze to the second glaze and which is partially located on the second glaze, wherein
the second glaze comprises:
a side edge part on a first glaze side; and
a cutout portion which is located on the side edge part, and which is opened toward the first glaze in the second direction, and
a portion of the lateral side part is arranged inside the cutout portion.

2. The thermal head according to claim 1, further comprising:
a second conductor layer on the glaze layer; and
a protective layer which is located on the second conductor layer above the first glaze and elongated in the first direction along the first glaze, wherein
the protective layer comprises an edge part on the second glaze side thereof projecting to the second glaze side at a position of the cutout portion.

3. The thermal head according to claim 1, wherein, in the lateral side part, a width of a portion in the first direction which is located in the cutout portion is broader than a width of a portion in the first direction which is located outside of an end part of the first glaze.

4. A thermal printer comprising:
a thermal head according to claim 1;
a conveying mechanism conveying a recording medium onto the thermal head; and
a platen roller pressing the recording medium against a top of the thermal head.

5. The thermal head according to claim 1, wherein the first conductive layer is arranged to extend from the surface of the substrate to the second glaze only along the cutout portion.

6. The thermal head according to claim 1, further comprising a second conductive layer arranged above the first conductive layer.

7. A thermal head comprising:
a substrate comprising a surface;
a glaze layer on the surface, comprising
a first glaze elongated in a first direction, and
a second glaze separated from the first glaze in a second direction perpendicular to the first direction;
a first conductive layer on the surface, comprising a lateral side part which extends from the first glaze to the second glaze and which is partially located on the second glaze;
the second glaze comprises:
a side edge part on a first glaze side; and
a cutout portion which is located on the side edge part, and which is opened toward the first glaze in the second direction;
a portion of the lateral side part is arranged inside the cutout portion;
a second conductor layer which is located on the glaze layer and on the first conductor layer;
a protective insulating layer which is located on the second conductor layer above the first glaze;
a protective conductor layer on the protective insulating layer; and
a reinforced insulating layer:
located between the second conductor layer and the protective conductor layer;
unoverlapped with the first glaze in an upper view; and
comprising a cutout corresponding part which is located on the lateral side part in the cutout portion and is thinner than the second glaze.

8. The thermal head according to claim 7, wherein
the reinforced insulating layer further comprises
a strip shaped portion which extends along the first glaze at a second glaze side of the first glaze, which comprises:
the cutout corresponding part; and
an edge part on the second glaze side thereof projecting the second glaze side at a position of the cutout portion.

9. The thermal head according to claim 7, wherein the reinforced insulating layer comprises a first material having a heat conductivity lower than that of a second material of the glaze layer.

10. The thermal head according to claim 7, wherein the reinforced insulating layer comprises a resin that is thicker than the protective insulating layer.

* * * * *